US005456025A

United States Patent [19]

Joiner et al.

[11] Patent Number: 5,456,025

[45] Date of Patent: Oct. 10, 1995

[54] APPARATUS FOR DETERMINING THE HUMIDITY OF EXHAUST AIR EXITING A YANKEE DRYER HOOD

[75] Inventors: John R. Joiner; Harvey L. Claussen, both of Vancouver; Richard M. Sisson, Washougal, all of Wash.

[73] Assignee: James River Paper Company, Inc., Richmond, Va.

[21] Appl. No.: 199,598

[22] Filed: Feb. 22, 1994

[51] Int. Cl.[6] ..... F26B 21/08

[52] U.S. Cl. ..... 34/528; 34/535; 34/557; 34/122; 73/29.01; 73/335.06

[58] Field of Search ..... 34/111, 114–116, 34/122, 443, 446, 528, 535, 537, 541, 557; 73/1 G, 29.01, 29.02, 335.06, 335.08, 77; 236/44 A; 261/94, 96, 109

[56] References Cited

U.S. PATENT DOCUMENTS

| | | |
|---|---|---|
| 1,894,172 | 1/1933 | Guthrie et al. . |
| 2,166,379 | 7/1939 | Skagerberg . |
| 2,316,624 | 4/1943 | Romanelli . |
| 3,037,375 | 6/1962 | Jacobs et al. . |
| 3,208,158 | 9/1965 | Smith, Jr. . |
| 3,265,301 | 8/1966 | Amdur et al. . |
| 3,532,270 | 10/1970 | Schoen, Jr. . |
| 3,665,748 | 5/1972 | Mator . |
| 4,221,058 | 9/1980 | Zagorzycki . |
| 4,413,427 | 11/1983 | Villalobos et al. . |
| 4,507,875 | 4/1985 | Hirsch et al. . |
| 4,597,285 | 7/1986 | Kuchar et al. . |
| 4,809,537 | 3/1989 | Glover et al. . |

OTHER PUBLICATIONS

Viswanathan and Rajappa, "A Continuous Analyser for Steam/Gas Ratio in Ammonia Plants," *Fertiliser News*, pp. 18–20.

*Primary Examiner*—Denise L. Gromada
*Attorney, Agent, or Firm*—Thomas R. Lampe

[57] ABSTRACT

An adiabatic saturator receives a sample of exhaust air exiting a yankee dryer hood to determine the humidity of the exhaust air. The humidity is determined by temperature readings of the exhaust air, saturated air exiting the interior of a saturator cell, and water supplied to the saturator cell interior. An air distributor in the saturator cell interior promotes saturation of the exhaust air and a backflush mechanism backflushes the saturator cell interior to keep the water in the cell interior clean.

20 Claims, 4 Drawing Sheets

APPARATUS FOR DETERMINING THE HUMIDITY OF EXHAUST AIR EXITING A YANKEE DRYER HOOD

TECHNICAL FIELD

This invention relates to the art of drying paper webs. More particularly, the invention is an apparatus for determining the humidity of exhaust air exiting the hood of a yankee dryer.

BACKGROUND ART

Yankee dryers have been used for many years to dry wet paper webs during the paper making process. Typically, the wet web is delivered to and pressed into engagement with the rotating dryer drum with the outer cylindrical surface of the dryer drum transporting the wet paper web through a dryer hood associated with the dryer drum. Both the dryer drum and the interior of the hood are heated to contribute to the drying operation.

It is known that paper making machines operators often use more makeup air than is actually required to carry away the water vapor within the interior of a yankee dryer hood. This significantly adds to cost of manufacture. The key indicator for economical operation is humidity of the exhaust air stream from the yankee hood. This measurement is very difficult to obtain because of the high temperatures of yankee exhaust air. Thus, the operator will usually err on the side of providing too much makeup air to ensure proper web drying.

Several commercial instruments, utilizing a variety of principles, have been tried in the past and, for a variety of reasons, none have proved satisfactory over time. Prior art techniques that have been tried or at least suggested are:

Insitu IR absorption

Sampling IR absorption

Insitu UV absorption

Insitu oxygen analyzer

Optical sampling dew pointer

Capacitance sampling dew pointer

Resonant piezoelectric sampling dew pointer

Heat flow sampling dew pointer

Sampling fluidic oscillator (density change with humidity)

Hot wire anemometer (heat transfer changes with humidity)

Insitu wet/dry bulb

Sampling wet-dry bulb

A search directed to the present invention located the following U.S. Pat. Nos.: 1,894,172, issued Jan. 10, 1933, U.S. Pat. No. 2,316,624, issued Apr. 13, 1943, U.S. Pat. No. 3,037,375, issued Jun. 5, 1962, U.S. Pat. No. 3,265,301, issued Aug. 9, 1966, U.S. Pat. No. 3,532,270, issued Oct. 6, 1970, U.S. Pat. No. 3,665,748, issued May 30, 1972, U.S. Pat. No. 4,507,875, issued Apr. 2, 1985, U.S. Pat. No. 4,597,285, issued Jul. 1, 1986, U.S. Pat. No. 4,809,537, issued Mar. 7, 1989, U.S. Pat. No. 2,166,379, issued Jul. 18, 1939, U.S. Pat. No. 3,208,158, issued Sep. 28, 1965, U.S. Pat. No. 4,221,058, issued Sep. 9, 1980, and U.S. Pat. No. 4,413,427, issued Nov. 8, 1983.

U.S. Pat. No. 1,894,172 discloses an apparatus for determining the moisture content of gases and is adapted for determining the moisture content of a flowing current of gas.

Means is provided for maintaining the gas at a substantially uniform temperature during testing.

U.S. Pat. No. 2,316,624 discloses an apparatus for determining moisture content in gases. In addition, moisture content of a gas is indicated as it flows along in a continuous stream.

U.S. Pat. No. 3,037,375 discloses a continuous vapor pressure apparatus for determining the vapor pressure of a liquid or mixture of liquids having different boiling points. A saturation chamber saturates the liquid with a gas in order to permit the gas and the liquid to attain an equilibrium condition as rapidly as possible. Saturation temperature will be determined by the liquid being tested and the specific test conditions.

U.S. Pat. No. 3,532,270 is directed to partial pressure low-level humidity generator. A solution is provided to the problem of adding extremely small and controlled quantities of moisture to dry air which differs fundamentally from the usual practice of saturating completely all or some divided portion of the air sample prior to a final operation. A sample source is supplied to a water bath and a makeup water source and temperature readouts are provided.

U.S. Pat. No. 3,265,301 is directed to an absolute humidity control device wherein a continuous sample of air is sensed from a high temperature moisture level space and is cooled to condense the moisture in the air, and the amount of heat removed to condense the moisture provides a continuous indication of the amount of moisture in a predetermined amount of air.

U.S. Pat. No. 3,665,748 discloses a calibrator moisture analyzer. The invention may be used when it is desired to produce a mixed fluid stream which consists of two fluids and which contains known concentrations of one of the fluids in the other fluid. Saturation of one fluid with the second fluid is required and means are provided for holding the saturating means at some constant temperature.

U.S. Pat. No. 4,507,875 is directed to a device for determining the concentration of condensable vapor in a flowing gas stream. The apparatus continuously determines the concentration of condensable gases or vapors in a flowing gas stream by removing a sample of the gas and conveying the sample at a constant, known volumetric flow through the conduits and to a gas condenser and flowmeter.

U.S. Pat. No. 4,597,285 is directed to a humidity control device which includes a fluidic oscillator through which a sample of gas is passed. The system is useful where the moisture content is large and there is a small difference between the molecular weight of water and the average molecular weight of the components of the gas vapor in the system.

U.S. Pat. No. 4,809,537 is directed to a system of continuously monitoring a wet bulb temperature in a flue gas. Samples of the flue gas are filtered and reheated to substantially the same temperature as the gas in the flue. The temperature of the reheated sample is measured with a sensor surrounded by a liquid absorbent wick which is immersed in a liquid maintained at a substantially constant level in a reservoir.

U.S. Pat. Nos. 2,166,379, 3,208,158, 4,221,058 and 4,413,427 all relate generally to humidity controlling devices associated with dryers.

An article entitled "A Continuous Analyser for Steam/Gas Ratio in Ammonia Plants" (authors T. S. Viswanathan and M. S. Rajappa) appeared in the March, 1983 edition of the magazine *FERTILISER NEWS*. The article discloses the use of an adiabatic saturator to determine the steam/gas ratio in the synthesis-gas producing section of an ammonia plant.

DISCLOSURE OF INVENTION

In general, the apparatus of the present invention employs an adiabatic saturator of specified construction designed for continuous use in the industrial environment of a paper making machine. The hot, moist air sample removed from the yankee dryer hood exhaust flow is brought into contact with an insulated water bath within a saturator cell of specialized character. The air is cooled and humidified by evaporation. Air exhausted from the bath chamber is saturated with moisture. Makeup water is supplied to hold the bath at a constant level. The temperatures of the air in and out of the bath chamber and the makeup water are utilized to determine the sample humidity. A water powered eductor is used to create a vacuum to pull the sample through the bath chamber. A back flush system incorporating a solenoid valve is utilized to back flush dirt buildup in the water bath.

With the apparatus of the present invention no field calibration is required, so no unreliable and inaccurate manual humidity tests are necessary. Furthermore, the apparatus employs no dirt or condensation sensitive pre-coolers as may be the case in prior art industrial humidity sensor arrangements. No exotic sensors are required to practice the invention.

The apparatus of the present invention incorporates a yankee dryer including a rotatable heated dryer drum having an outer cylindrical surface for supporting and drying a paper web during transport of the paper web through a paper making machine. The yankee dryer also incorporates a dryer hood partially encompassing the dryer drum and having a hood interior through which the paper web is transported by the dryer drum. The hood has an exhaust air exit for exhausting air from the hood interior.

The apparatus includes an adiabatic saturator having an inlet in communication with the hood interior for introducing a sample of the exhaust air exiting the hood into the adiabatic saturator. The adiabatic saturator is for determining the humidity of the exhaust air exiting the hood interior.

The adiabatic saturator includes a saturator cell having insulated housing walls including a side wall and a bottom wall defining a cell interior. The adiabatic saturator inlet is defined by a conduit extending between the hood of the yankee dryer and the saturator cell.

The conduit extends into the interior of the saturator cell with the conduit defining an exit opening adjacent to the saturator cell bottom wall.

Water supply means supplies water to the saturator cell and maintains the water level in the saturator cell at a constant level.

Air distributor means disposed about the conduit and located between the conduit and the saturator cell side wall is immersed in the water in the cell interior. The distributor means laterally deflects air exiting the conduit exit opening and rising to the surface of the water in the saturator cell to prolong contact between the water and the rising air and promote saturation of the rising air by the water.

Other features, advantages, and objects of the present invention will become apparent with reference to the following description and accompanying drawings.

BEST MODE FOR CARRYING OUT THE INVENTION

Figure 1:
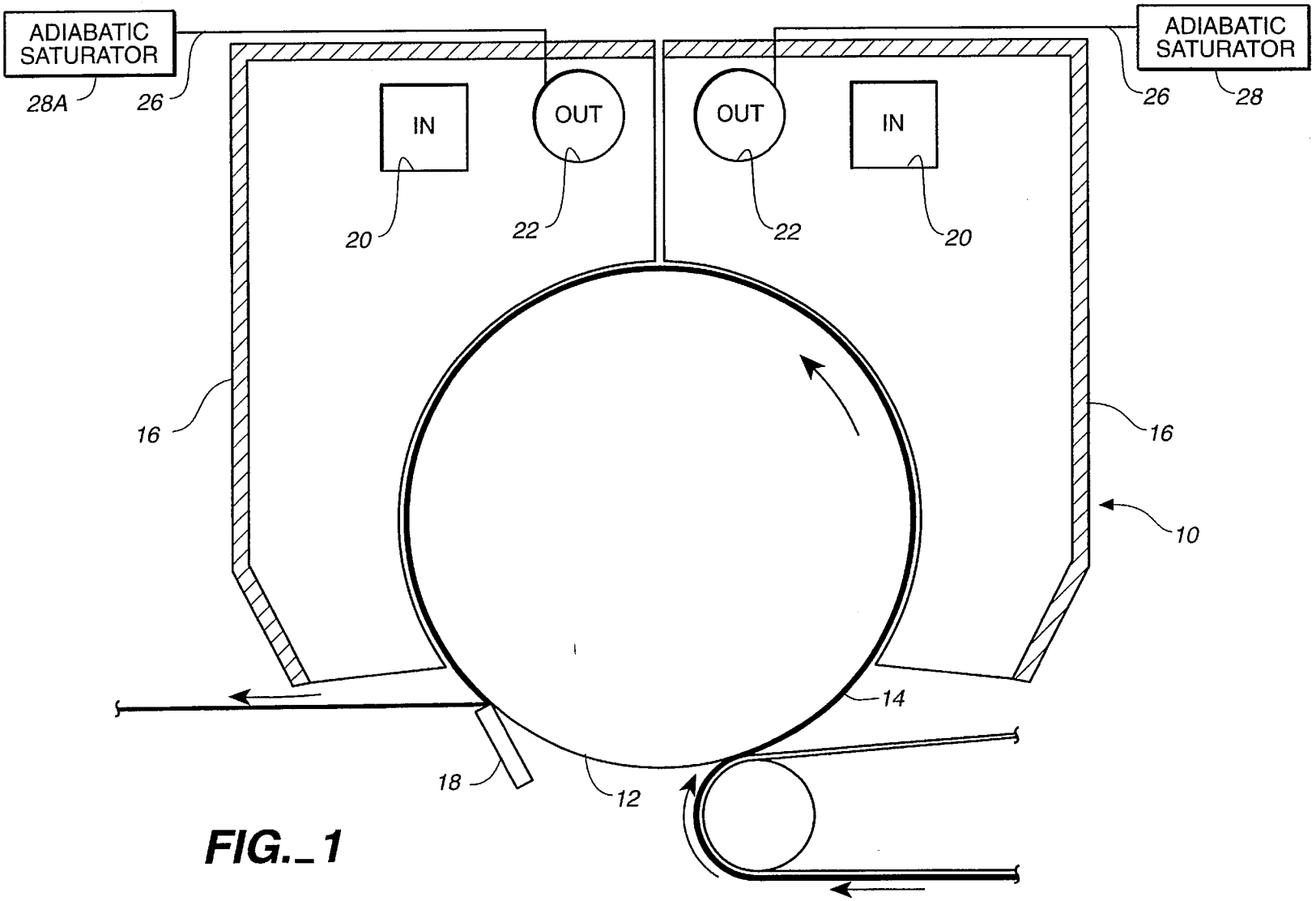
FIG. 1 is a schematic side view of a yankee dryer illustrating diagrammatically the use of adiabatic saturators to receive air samples from the exhaust of the yankee dryer hood.

Referring now to the drawings, a conventional yankee dryer 10 is illustrated, the yankee dryer having a rotatable heated dryer drum 12 with an outer cylindrical surface for supporting and drying a paper web 14.

The yankee dryer, as is conventional, also includes a dryer hood having two hood segments 16 partially encompassing the dryer drum and defining a hood interior into which the paper web is transported by the dryer drum. After passing through the two compartments defined by hood segments 16, the paper web is creped from the dryer drum by a creping blade 18.

While in the hood interior, the paper web is impacted by heated air circulated through the hood, the hood having one or more inlets 20 for such purpose as well as one or more outlets such as outlet 22 for the exhaust air. In the arrangement illustrated, each segment 16 has an inlet 20 and an outlet 22.

A conduit 26 extends between each segment of the hood and an adiabatic saturator. In the arrangment shown, an adiabatic saturator 28 is fed by one conduit 26 and another adiabatic saturator 28A by another conduit 26. More specifically, each conduit 26 leads to a saturator cell 30 of the type illustrated in FIGS. 3–6 having insulated housing walls including a side wall 32 and a bottom wall 34 defining a cell interior. Conduit 26 extends into the interior of the saturator cell and defines an exit opening 52 adjacent to the saturator cell bottom wall.

Water is disposed within the saturator cell interior and is maintained at a constant level therein. In the overall arrangement illustrated in schematic fashion in FIG. 2, fresh water is supplied to the interior of the saturator cell from a level pot 38 which in turn receives water from a source of fresh water (not shown) through a water/air separator 40 operatively associated with a rotameter 42. A supply line 44 leads from the source of fresh water to the separator. In the arrangement illustrated, a valve 46 in the line 44 is adjusted to set the air flow displayed by rotameter 42.

Figure 2:
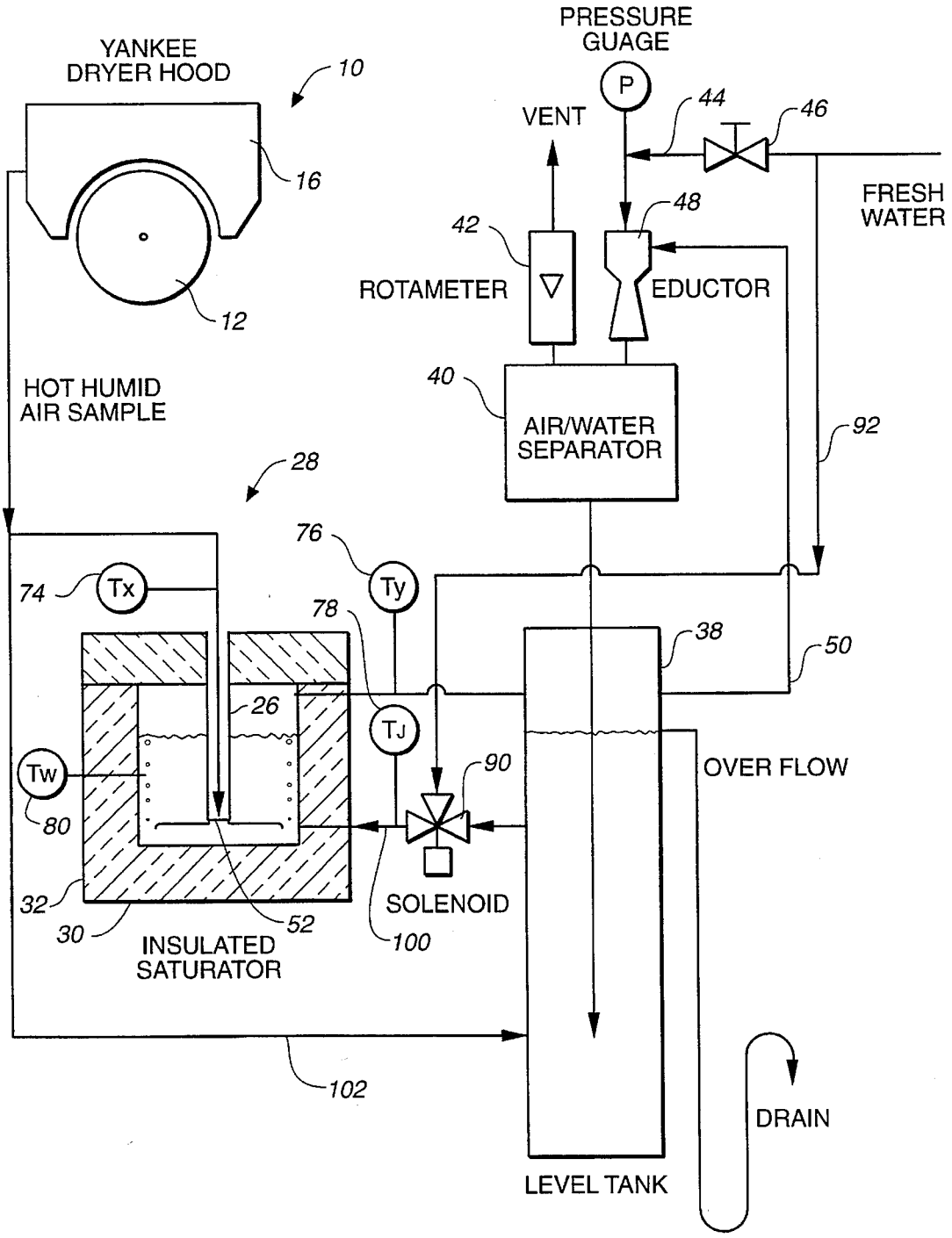
FIG. 2 is a schematic view of the adiabatic saturator employed according to the teachings of the present invention.
Figure 3:
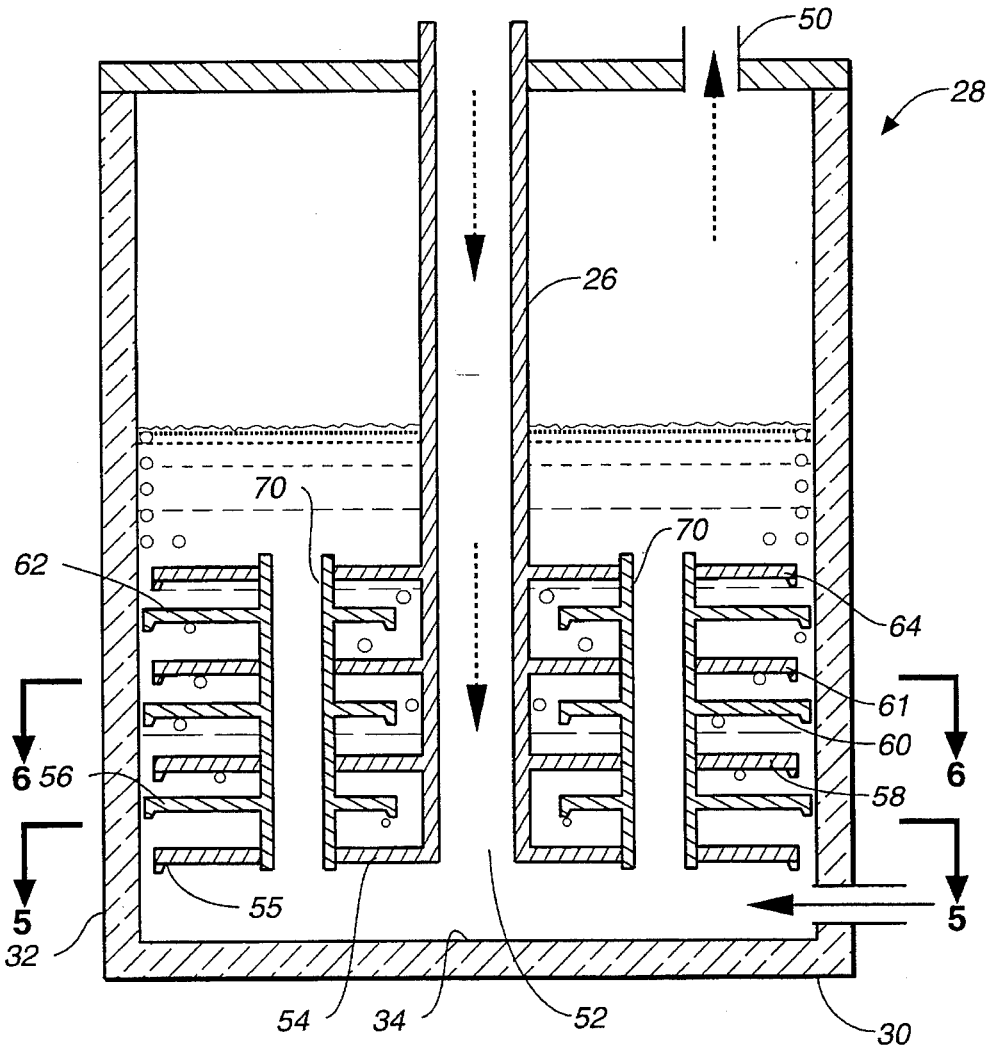
FIG. 3 is an enlarged diagrammatic cross-sectional view of the saturator cell employed in the adiabatic saturator.

It will be noted that an eductor 48 is disposed in the water flow path defined by line 44 upstream from the separator 40. Excess water in the level pot 38 overflows and is directed to a drain, as shown in FIG. 2.

Flow of water through eductor 48 will apply a vacuum to the interior of the saturator cell through an air exit pipe 50 connected to the cell and extending into the interior thereof. As a consequence, sample exhaust air from the hood will move down conduit 26 and exit the exit opening 52 of the conduit.

The objective is to saturate the air exiting the conduit 26 with the water in saturator cell 30. To accomplish this result it is desirable to prolong contact between the air exiting the conduit and the water in the cell.

Figure 4:
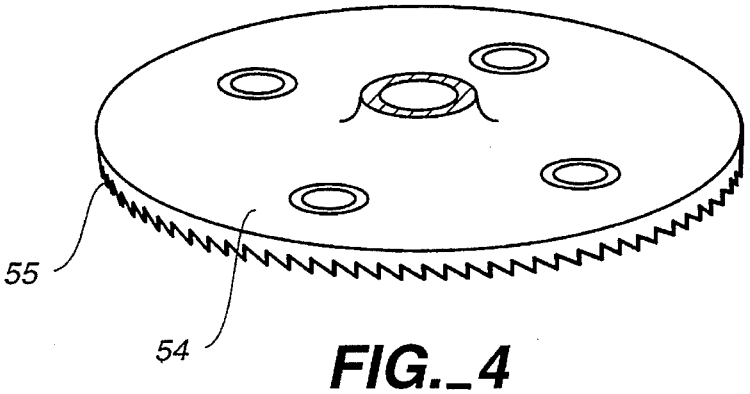
FIG. 4 is a perspective view of a plate employed in the saturator cell.
Figure 5:
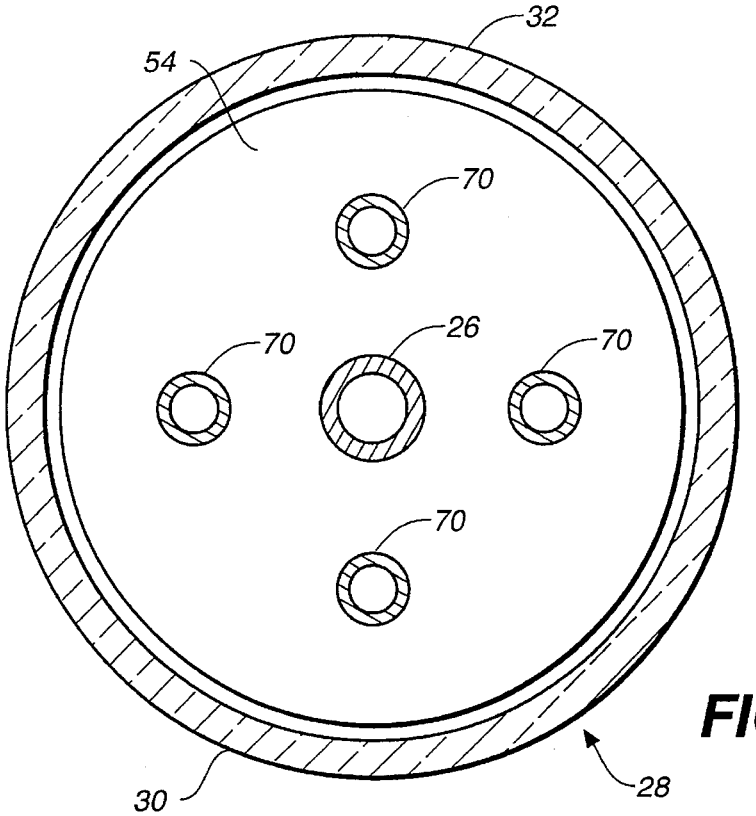
FIG. 5 is a cross-sectional view taken along the line 5—5 in FIG. 3.
Figure 6:
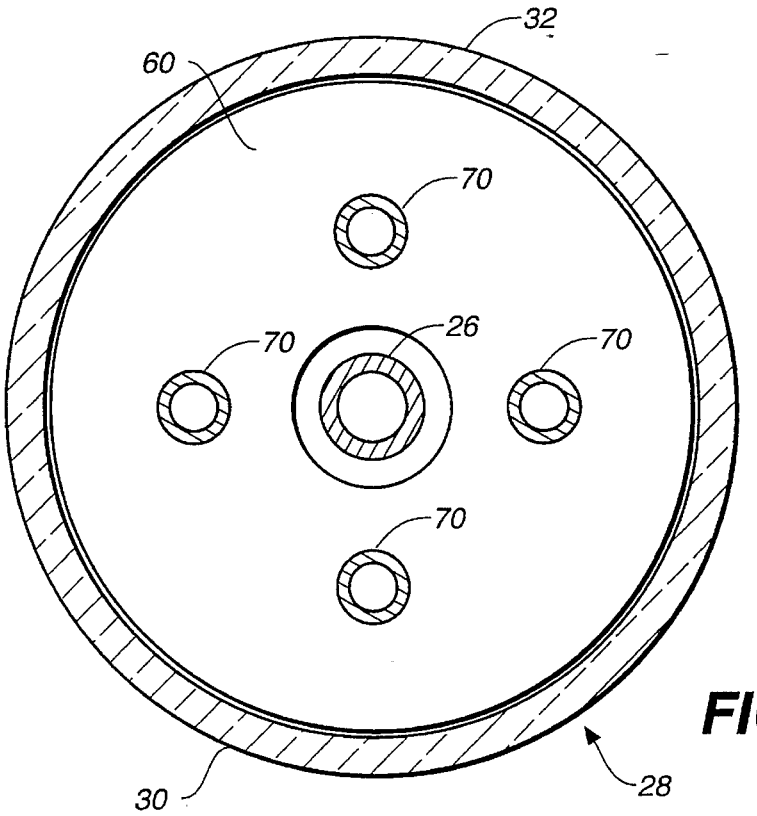
FIG. 6 is a cross-sectional view taken along the line 6—6 in FIG. 3.

Referring now to FIGS. 3–6, surrounding and attached to conduit 26 at the exit opening 52 thereof is a plate 54 of any suitable material which radiates outwardly toward the side wall 32. The distal end or edge of plate 54 is spaced from the side wall, defining a gap therewith. Plate 54 is flat and level except at the outer edge 55 thereof, edge 55 being downturned and serrated as shown in FIG. 4. Air from conduit 26 will flow along the bottom of plate 54 forming an air layer due to the existence of downturned edge 55 and rise upwardly between the serrations of edge 55 through the gap between the plate edge and side wall 32.

A flat, level plate 56 is disposed above plate 54. Plate 56 is connected to conduit 56 and has a downturned unserrated outer edge close enough to side wall 32 to catch the bubbles escaping from plate 54. The inner edge of plate 56 terminates prior to engagement with conduit 26 and is also downturned and serrated. Thus a thin layer of air will form along the bottom of plate 56 and flow upwardly between the conduit 26 and the serrated inner edge of the plate 56 in the form of air bubbles.

Plates 58, 60, 61, 62 and 64 are arranged in a like manner so that the air passing upwardly from the bottom of the saturator cell must traverse a labyrinthine flow path defined by the bottoms of the tiered series of plates. This will accomplish the desired prolonged contact between the water and the air and promote saturation of the rising air by the water. Saturation can be accomplished within a relatively short vertical distance as compared to an arrangement wherein the air would simply rise vertically within the cell; thus, the saturator cell may be relatively compact.

It will be noted that a plurality of water circulation pipes 70 extend through the plates at locations spaced from each other and from conduit 26. The pipes each have opposed open ends below the level of the water in the saturator cell. Movement of the air within the cell will cause water movement or "pumping" to some degree and the pipes 70 will further promote circulation of the moving water within the cell to avoid stratification, it being of course desirable in adiabatic saturators to maintain a constant and uniform water temperature.

The saturated air will pass upwardly through pipe 50 due to the action of eductor 48 and will be delivered to separator 40. Separator 40 will separate the air from the water, allow for venting of the air through rotameter 42 and recirculation of the water back into level pot 38.

As stated above, the objective of the present invention is to provide for an accurate determination of the humidity of the air being exhausted from the yankee dryer hood. This is accomplished by measuring temperatures at various locations in the adiabatic saturator. A thermometer 74 measures the temperature of the air sample being delivered to the saturator cell by conduit 26, the temperature being designated as $T_X$. A thermometer 76 measures the temperature $T_Y$ of the saturated air passing from the saturator cell to eductor 48 through pipe 50. Thermometer 78 measures the temperature $T_J$ of the make-up water going to the saturator cell interior. A fourth thermometer 80 is employed to be certain that the temperature of water in the cell is the same as the exit air temperature. This will only be the case if the exit air has reached a saturated condition. If the exit air is not saturated but is close to saturation, it is possible to predict the saturated temperature from the water and exit air temperatures.

Humidity of the hot humid air sample ($H_X$) can be determined by using the following formulae wherein X is the hot humid air sample, J is the make up water supply, and Y is the saturated air exiting the saturator cell. In the formulae, T= Temperature, F=Mass Flow, E=Enthalpy, H=Humidity, A=Air, V= Vapor, W=Liquid Water. The pertinent formulae are:

Conservation of Energy:

$$E_{AX}F_{AX} + E_{VX}F_{VX} + E_{WJ}F_{WJ} = E_{AY}F_{AY} + E_{VY}F_{VY}$$

Conservation of Mass:

$$F_{VX} + F_{WJ} = F_{VY} \qquad F_{AX} = F_{AY}$$

Definition of Humidity:

$$H_X = \frac{F_{VX}}{F_{AX}} \quad H_Y = \frac{F_{VY}}{F_{AY}}$$

Solving for $H_X$:

$$H_X = \frac{H_Y(E_{VY} - E_{WJ}) - (E_{AX} - E_{AY})}{E_{VX} - E_{WJ}}$$

$H_Y$ is Saturated @ $T_Y$ $H_Y$, $E_{AX}$, $E_{VX}$, $E_{AY}$, $E_{VY}$, $E_{WJ}$ are all known from $T_X$, $T_Y$, $T_J$; that is, these parameters are all known from temperatures by using published psychrometric table data.

Preferably, a suitably programmed computer sensing the output from the various thermometers will provide the calculation on an ongoing, on-line basis.

Over time the water within the saturator cell may become dirtied. For this reason, it is a preferred feature of the present invention to provide an arrangement for back flushing the interior of the saturator cell. To accomplish this, a three-way solenoid operated valve 90 is disposed in the water line 100 extending between saturator cell 30 and make-up pot 38. A line 92 extends between valve 90 and the fresh water supply line 44. Thus, valve 90 can selectively introduce make-up water or pressurized supply water into the cell, the latter causing back flushing and cleaning of the cell. The line 102 between the sample inlet and the level pot permits backflush water to drain from the sample line.

We claim:

1. Apparatus comprising, in combination:

a yankee dryer including a rotatable heated dryer drum having an outer cylindrical surface for supporting and drying a paper web during transport of said paper web through a paper making machine and a dryer hood partially encompassing said dryer drum and having a hood interior through which the paper web is transported by said dryer drum, said hood having an exhaust air exit for exhausting air from said hood interior; and an adiabatic saturator having an inlet in communication with the hood interior for introducing a sample of the exhaust air exiting said hood into said adiabatic saturator, said adiabatic saturator for determining the humidity of the exhaust air exiting said hood interior.

2. The apparatus according to claim 1 wherein said adiabatic saturator includes a saturator cell having insulated housing walls including a side wall and a bottom wall defining a cell interior, said adiabatic saturator inlet being defined by a conduit extending between said hood and said saturator cell and into the interior of said saturator cell, said conduit defining an exit opening adjacent to the saturator cell bottom wall, water supply means for supplying water to said saturator cell and maintaining the water level in said saturator cell at a constant level, and air distributor means disposed about said conduit and located between said conduit and said saturator cell side wall, said air distributor means immersed in the water in said cell interior to laterally deflect air exiting said conduit exit opening and rising to the surface of the water in the saturator cell to prolong contact between said water and said rising air and promote saturation of said rising air by said water.

3. The apparatus according to claim 2 wherein said air distributor means has a tiered series of air engagement surfaces defining a labyrinthine air flow path which must be traversed by said air exiting said conduit exit opening as the air rises to the surface of the water in said saturator cell.

4. The apparatus according to claim 3 wherein said air distributor means comprises a plurality of plates disposed vertically with respect to one another and spaced from one another extending laterally between said saturator cell side wall and said conduit, the undersides of said plates comprising said air engagement surfaces.

5. The apparatus according to claim 4 wherein at least some of said plates have serrated edges.

6. The apparatus according to claim 4 wherein said plates have distal edges and said undersides are curved downwardly at said distal edges.

7. The apparatus according to claim 4 wherein a plurality of water circulation pipes extend through said plates at locations spaced from each other and from said conduit, said pipes each having opposed open ends below the level of the water in said saturator cell for promoting circulation of water within said cell interior.

8. The apparatus according to claim 2 wherein said adiabatic saturator additionally includes an air exit pipe connected to said saturator cell and extending into the cell interior for removing air from said cell interior after said air has passed said distributor means and through the water in said cell interior, and eductor means operatively associated with said air exit pipe for drawing air from said cell interior.

9. The apparatus according to claim 2 including backflush means for backflushing said saturator cell to clean the cell interior.

10. The apparatus according to claim 8 wherein said eductor means is operatively associated with said water supply means and responsive to movement of water in said water supply means to draw a vacuum in said saturator cell interior through said air exit pipe.

11. The apparatus according to claim 8 wherein said adiabatic saturator additionally comprises a plurality of temperature sensors to sense the temperature of air entering said saturator cell through said conduit, the temperature of saturated air exiting said cell interior through said air exit pipe, and the temperature of water supplied to and in said cell interior by said water supply means.

12. An adiabatic saturator having an inlet for introducing an air sample into said adiabatic saturator, said adiabatic saturator for determining the humidity of the air sample, said adiabatic saturator including a saturator cell having insulated housing walls including a side wall and a bottom wall defining a cell interior, said adiabatic saturator inlet being defined by a conduit extending to said saturator cell and into the interior of said saturator cell, said conduit defining an exit opening adjacent to the saturator cell bottom wall, water supply means for supplying water to said saturator cell and maintaining the water level in said saturator cell at a constant level, and air distributor means disposed about said conduit and located between said conduit and said saturator cell side wall, said air distributor means immersed in the water in said cell interior to laterally deflect air exiting said conduit exit opening and rising to the surface of the water in the saturator cell to prolong contact between said water and said rising air and promote saturation of said rising air by said water.

13. The apparatus according to claim 12 wherein said air distributor means has a tiered series of air engagement surfaces defining a labyrinthine air flow path which must be traversed by said air exiting said conduit exit opening as the air rises to the surface of the water in said saturator cell.

14. The apparatus according to claim 13 wherein said air distributor means comprises a plurality of plates disposed vertically with respect to one another and spaced from one another extending laterally between said saturator cell side wall and said conduit, the undersides of said plates comprising said air engagement surfaces.

15. The apparatus according to claim 14 wherein at least some of said plates have serrated edges.

16. The apparatus according to claim 14 wherein said plates have distal edges and said undersides are curved downwardly at said distal edges.

17. The apparatus according to claim 14 wherein a plurality of water circulation pipes extend through said plates at locations spaced from each other and from said conduit, said pipes each having opposed open ends below the level of the water in said saturator cell for promoting circulation of water within said cell interior.

18. The apparatus according to claim 12 wherein said adiabatic saturator additionally includes an air exit pipe connected to said saturator cell and extending into the cell interior for removing air from said cell interior after said air has passed said distributor means and through the water in said cell interior, and eductor means operatively associated with said air exit pipe for drawing air from said cell interior.

19. The apparatus according to claim 12 including backflush means for backflushing said saturator cell to clean the cell interior.

20. The apparatus according to claim 18 wherein said eductor means is operatively associated with said water supply means and responsive to movement of water in said water supply means to draw a vacuum in said saturator cell interior through said air exit pipe.

* * * * *